US009800001B2

(12) United States Patent
Jaussi et al.

(10) Patent No.: US 9,800,001 B2
(45) Date of Patent: Oct. 24, 2017

(54) RATE SCALABLE CONNECTOR FOR HIGH BANDWIDTH CONSUMER APPLICATIONS

(71) Applicant: Intel Corporation, Santa Clara, CA (US)

(72) Inventors: James E. Jaussi, Hillsboro, OR (US); Stephen R. Mooney, Mapleton, UT (US); Howard L. Heck, Hillsboro, OR (US); Bruce E. Pederson, Hillsboro, OR (US); Bryan K. Casper, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/152,019

(22) Filed: May 11, 2016

(65) Prior Publication Data

US 2016/0352055 A1 Dec. 1, 2016

Related U.S. Application Data

(63) Continuation of application No. 13/997,096, filed as application No. PCT/US2011/064927 on Dec. 14, 2011, now Pat. No. 9,362,684.

(51) Int. Cl.
*H01R 24/64* (2011.01)
*H01R 12/72* (2011.01)
(Continued)

(52) U.S. Cl.
CPC ..... *H01R 24/64* (2013.01); *H01R 12/721* (2013.01); *H01R 13/66* (2013.01);
(Continued)

(58) Field of Classification Search
CPC ..... H01R 24/64; H01R 12/721; H01R 13/66; H01R 13/6658; H01R 24/62; H01R 24/28
(Continued)

(56) References Cited

U.S. PATENT DOCUMENTS 5,073,130 A * 12/1991 Nakamura ..... H01R 13/65802 439/607.32
5,273,459 A * 12/1993 Davis ..... H01R 13/65802 439/607.48
(Continued)

FOREIGN PATENT DOCUMENTS

TW M398226 U 2/2011
WO 2013089704 A1 6/2013

OTHER PUBLICATIONS

Abandonment for U.S. Appl. No. 13/997,096, mailed Jul. 1, 2014, 1 page.
(Continued)

*Primary Examiner* — Alexander Gilman
(74) *Attorney, Agent, or Firm* — Nicholson De Vos Webster & Elliott, LLP

(57) ABSTRACT

Methods and systems may include an input/output (IO) interface that has an integrated buffer, a housing and a substrate disposed within the housing. The substrate may include a first side, a second side and a connection edge. The integrated buffer can be coupled to at least one of the first side and the second side of the substrate. A plurality of rows of contacts may be coupled to the first side of the substrate. Each row of contacts can be stacked substantially parallel to the connection edge. The substrate may have power outputs coupled thereto and the integrated buffer can include a voltage regulator that has a supply output coupled to the power outputs.

20 Claims, 3 Drawing Sheets

(51) Int. Cl.
*H01R 13/66* (2006.01)
*H01R 24/62* (2011.01)
*H01R 107/00* (2006.01)
*H01R 24/28* (2011.01)

(52) U.S. Cl.
CPC ..... *H01R 13/6658* (2013.01); *H01R 24/62* (2013.01); *H01R 24/28* (2013.01); *H01R 2107/00* (2013.01)

(58) Field of Classification Search
USPC ..... 439/676, 629, 89, 76.1
See application file for complete search history.

(56) References Cited

U.S. PATENT DOCUMENTS 5,409,400 A 4/1995 Davis
5,518,421 A * 5/1996 Davis ..... H01R 13/506 439/607.5
5,716,236 A 2/1998 O'Sullivan et al.
5,785,557 A * 7/1998 Davis ..... H01R 13/26 439/108
5,833,495 A 11/1998 Ito
5,955,703 A * 9/1999 Daly ..... H01R 13/6658 174/117 R
5,967,802 A * 10/1999 Daly ..... H01R 13/6658 439/620.09
6,007,381 A * 12/1999 Ando ..... H01R 12/7064 439/607.01
6,050,853 A * 4/2000 Ando ..... H01R 12/716 439/571
6,629,181 B1 * 9/2003 Alappat ..... G06F 13/409 439/55
6,629,858 B2 10/2003 Lo et al.
6,633,932 B1 * 10/2003 Bork ..... G06F 1/266 320/107
6,705,894 B1 3/2004 Comerci et al.
6,739,883 B1 5/2004 Cheng et al.
6,783,397 B2 8/2004 Yang
6,860,762 B2 * 3/2005 Spykerman ..... G11B 33/122 363/142
7,021,971 B2 * 4/2006 Chou ..... G06K 19/07732 439/218
7,104,848 B1 * 9/2006 Chou ..... G06K 19/07732 439/660
RE39,380 E * 11/2006 Davis ..... 439/108
7,134,914 B1 11/2006 Wu
7,155,545 B1 * 12/2006 Wang ..... G06F 13/409 439/660
7,341,487 B2 3/2008 Wu
7,359,208 B2 * 4/2008 Ni ..... G11B 33/12 174/50.51
7,380,991 B2 6/2008 Schempp
7,527,527 B2 5/2009 Morlion et al.
7,717,733 B1 * 5/2010 Yi ..... H01R 4/184 439/452
7,758,379 B2 * 7/2010 Chen ..... H01R 13/6485 439/607.11
7,872,873 B2 * 1/2011 Hiew ..... G06F 1/1632 361/715
8,033,868 B2 * 10/2011 Wang ..... H01R 13/405 439/660
8,102,657 B2 * 1/2012 Hiew ..... G06F 1/1632 361/737
8,172,585 B2 * 5/2012 Chiu ..... H01R 27/00 439/108
8,257,114 B2 * 9/2012 Wang ..... H01R 12/57 439/607.01
8,297,987 B2 * 10/2012 Nguyen ..... G06K 19/07732 439/76.1
8,337,253 B2 * 12/2012 Gao ..... H01R 13/741 439/660
8,439,708 B2 * 5/2013 Colantuono ..... H01R 13/6275 439/607.41
8,602,825 B2 * 12/2013 Chen ..... H01R 13/6658 439/660
8,684,769 B2 * 4/2014 Kao ..... H01R 13/6471 439/607.28
8,828,330 B2 * 9/2014 Galasso ..... A61B 5/14532 422/400
8,968,031 B2 * 3/2015 Simmel ..... H01R 13/659 439/108
9,106,217 B2 * 8/2015 Jaussi ..... H01R 13/6658
9,318,853 B2 * 4/2016 Little ..... H01R 13/6658
9,362,684 B2 * 6/2016 Jaussi ..... H01R 12/721
9,466,929 B2 * 10/2016 Wu ..... H01R 24/60
9,502,821 B2 * 11/2016 Little ..... H01R 13/6582
2002/0123256 A1 * 9/2002 Brickett ..... H01R 13/533 439/140
2005/0059301 A1 3/2005 Chou et al.
2005/0159047 A1 7/2005 Takahashi
2009/0130873 A1 * 5/2009 He ..... H01R 13/6477 439/108
2010/0203751 A1 * 8/2010 Tsai ..... H01R 13/6658 439/222
2010/0267261 A1 * 10/2010 Lin ..... H01R 13/6461 439/218
2012/0052731 A1 * 3/2012 Hsiao ..... H01R 13/6658 439/620.22
2013/0252467 A1 * 9/2013 Chen ..... H01R 13/6658 439/626
2014/0170867 A1 * 6/2014 Hodge ..... H01R 12/62 439/67
2014/0370728 A1 * 12/2014 Shiratori ..... H01R 13/6471 439/95
2015/0171562 A1 * 6/2015 Gao ..... H01R 13/6582 439/345

OTHER PUBLICATIONS

Extended European Search Report for European Patent Application No. 11877554.3, mailed Aug. 7, 2015, 6 pages.
Extended European Search Report for European Patent Application No. 16184360.2, mailed Jan. 4, 2017, 7 pages.
"Inter-Chip Supplement to the USB Revision 3.0 Specification," Revision 1.01, Feb. 11, 2013, 67 pages.
International Preliminary Report on Patentability for Application No. PCT/US2011/064927, mailed on Jun. 26, 2014, 7 pages.
International Search Report and Written Opinion for Application No. PCT/US2011/064927, mailed on Aug. 14, 2012, 10 pages.
Large Errata Section, USB 3.0 Errata, Q1'09, Released May 15, 2009, 74 pages.
"High Definition Multimedia Interface Specification Version 1.3a," HDMI Licensing LLC, Nov. 10, 2006, 29 pages.
LTSSM Timeout Naming Errata, Names of timeouts in chapter 7.5.4 and 7.5.10, 7 pages.
Non-final Office Action from U.S. Appl. No. 13/997,096, mailed Sep. 4, 2015, 13 pages.
Notice of Allowance from U.S. Appl. No. 13/997,096, mailed Feb. 11, 2016, 11 pages.
"On-The-Go and Embedded Host Supplement to the USB Revision 3.0 Specification," Revision 1.1, May 10, 2012, 74 pages.
Universal Serial Bus 3.0 Specification "Figure 10-9: Downstream Facing Hub Port State Machine," Art #: U-148, Mar. 11, 2008, ECN# 003, 1 page.
"Universal Serial Bus 3.0 Specification, Revision 1.0 (including errata and ECNs through May 1, 2011)," Jun. 6, 2011, 631 pages.
"Universal Serial Bus Power Delivery Specification," Revision 1.0, Including Errata through Jun. 26, 2013 (Version 1.2), 328 pages.
"Universal Serial Bus Power Delivery Specification," Revision 1.0, Including Errata through Oct. 31, 2012 (Version 1.1), 372 pages.
"USB 3.0 Adopters Agreement," Agreement_020411, 6 pages.
USB 3.0 Engineering Change Notice "Clarification on the Chamfer on USB 3.0 Micro Connectors," USB3.0 Specification Revision 1.0, Nov. 12, 2008, ECR# 004, 6 pages.
USB 3.0 Engineering Change Notice "DSPORT State Machine," USB3.0 (11132008)—final, ECN# 010, 11 pages.

(56) References Cited

OTHER PUBLICATIONS

USB 3.0 Engineering Change Notice "Maximum Un-mating force value definition to micro connector USB 3.0," Revision 1.0, ECR# 005, 3 pages.
USB 3.0 Engineering Change Notice, Reset Propagation "USB3.0 Reset Propagation through Hubs," USB3.0 (11132008)—final, ECN# 003, 4 pages.
USB 3.0 Engineering Change Notice "USB 3.0—Relaxation of tRx Detect Quiet Timeout", USB3_r1.0_06_06_2011, ECN# 020, 2 pages.
USB 3.0 Engineering ECNs Change Notice "USB3.0 Connector Crosstalk Spec," USB3.0 Specification (including errata and ECMs through May 1, 2011), ECR# 016, 3 pages.
USB 3.0 Engineering Change Notice "USB3.0 Contact Plating Thickness," USB3.0 (11132008)—final, ECN# 008, 3 pages.
USB 3.0 Engineering Change Notice "USB3.0 Efficient ISO and PINGs," USB3.0 (11132008)—final, ECN# 007, 6 pages.
USB 3.0 Engineering Change Notice "USB3.0 MicroAB Connector," USB3_r1.0_06_06_2011, ECN# 017, 3 pages.
USB 3.0 Engineering Change Notice "USB3.0 MicroB Cable Loss Specification," USB3_r1.0_06_06_2011, ECN# 019, 5 pages.
USB 3.0 Engineering Change Notice "USB3.0 Peripheral USPort State Machines ECR," USB3.0 (11132008)—final, ECN# 011, 8 pages.
USB 3.0 Engineering Change Notice "USB3.0 Radio Friendly Clock Unit Interval," USB3_r1.0_06_06_2011, ECN#018, 5 pages.
USB 3.0 Engineering Change Notice "USB3.0 Reference Equalizer," USB3_r1.0_06_06_2011, ECN #012, 2011, 6 pages.
USB 3.0 Engineering Change Notice "USB3.0 Spread Spectrum Clock Range," USB3_r1.0_06_06_2011, ECR# 015, 3 pages.
USB 3.0 Engineering Change Notice "USB3.0 Standard a Contact Height" USB3.0 Specification (including errata and ECNs through May 1, 2011), ECN# 014, 4 pages.
USB 3.0 Engineering Change Notice "USB3.0 Standard A Receptacle," USB3.0 Specification (including errata and ECNs through May 1, 2011), ECN #013, 3 pages.
USB 3.0 Engineering Change Notice "USB3.0 Standard-B Connector Near End Crosstalk," USB3.0 (11132008)—final and ECN# 002, ECN# 009, 5 pages.
USB 3.0 Engineering Change Notice "USB3.0 State Machines ECN," USB3.0 (11132008)—final, ECN# 006, 20 pages.
USB 3.0 Engineering Change Notification "USB3.0 Standard-B and Standard-B Crosstalk," USB3.0 (11132008)—final, ECN# 002, Apr. 4, 2009, 8 pages.
USB 3.0 Engineering Change Request Form "New Addition of Link command LDN," USB3.0 (11132008)—final, ECN# 001, 10 pages.
USB 3.0 Errata, May 1, 2011, 28 pages.
USB 3.0 Errata, Jun. 9, 2010, 50 pages.

* cited by examiner

FIG. 1A
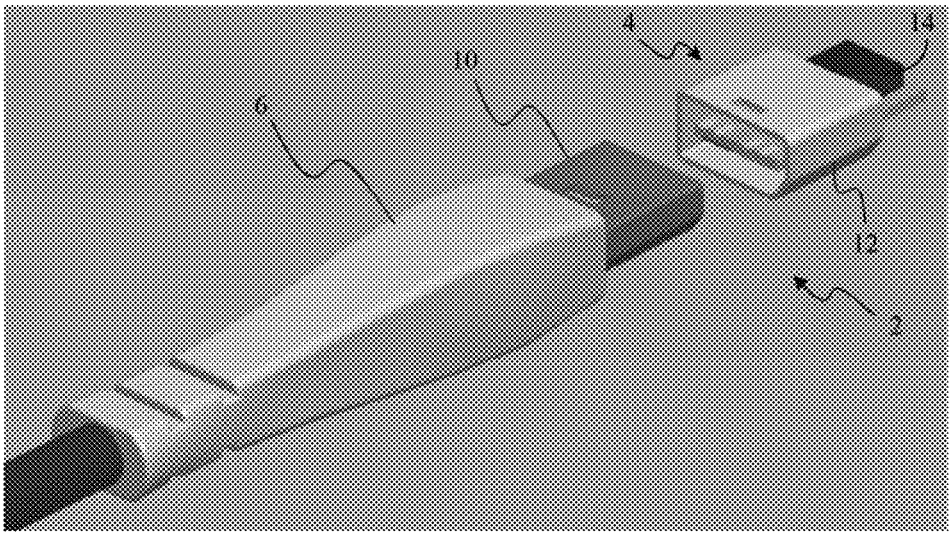
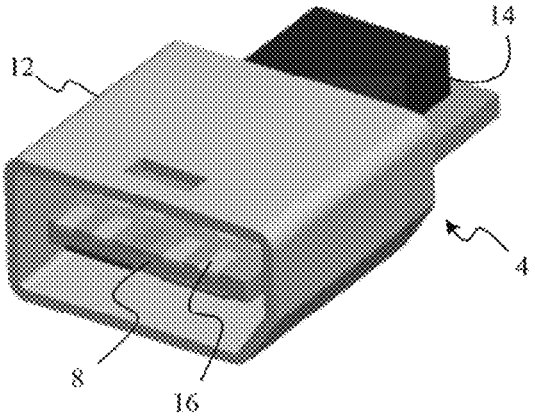
FIG. 1B
FIG. 2
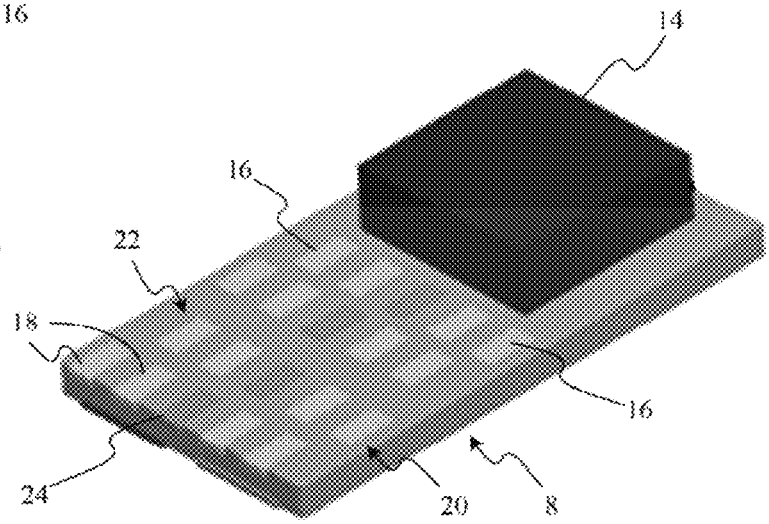

RATE SCALABLE CONNECTOR FOR HIGH BANDWIDTH CONSUMER APPLICATIONS

CROSS-REFERENCE WITH RELATED APPLICATIONS

This application is a continuation of U.S. National Phase patent application Ser. No. 13/997,096 filed on Jul. 22, 2014, which claims benefit to International Patent Application PCT/US2011/064927 filed on Dec. 14, 2011.

BACKGROUND

Technical Field

Embodiments are generally related to input/output (IO) bus devices and, more particularly, to an IO connector that is scalable and supports high bandwidth communications.

Discussion

Future platforms and "consumption devices" (like flash or Phase Change Memory Stacked/PCMS drives) may demand higher bandwidths than offered by current input/output (IO) interface solutions such as USB (Universal Serial Bus, e.g., USB Specification 3.0, Rev. 1.0, Nov. 12, 2008, USB Implementers Forum), and PCIE ("Peripheral Component Interconnect Express", e.g., PCI Express x16 Graphics 150W-ATX Specification 1.0, PCI Special Interest Group) solutions. This development may require replacing existing connector technologies due to potentially excessive signal degradation at frequencies below 10 GHz. Indeed, a large enabling effort associated with new connector technologies may place a demand for multiple generation (10+ year) scalability on any new connector.

For example, USB devices may be configured to couple to other USB compatible devices using a standardized USB connector. Included in the USB connector can be a power source connection, which transfers power between coupled USB devices. Although USB connections have gone through multiple generations of development, the capabilities of USB connectors may be nearing a limit.

BRIEF DESCRIPTION OF THE ACCOMPANYING DRAWINGS

The various advantages of the embodiments of the present invention will become apparent to one skilled in the art by reading the following specification and appended claims, and by referencing the following drawings, in which:

FIG. 1A shows an example of a connector pair including male and female connectors according to an embodiment;

FIG. 1B shows an example of a scalable connector according to an embodiment;

FIG. 2 shows an example of a host connector and substrate according to an embodiment;

DETAILED DESCRIPTION

Figure 3:
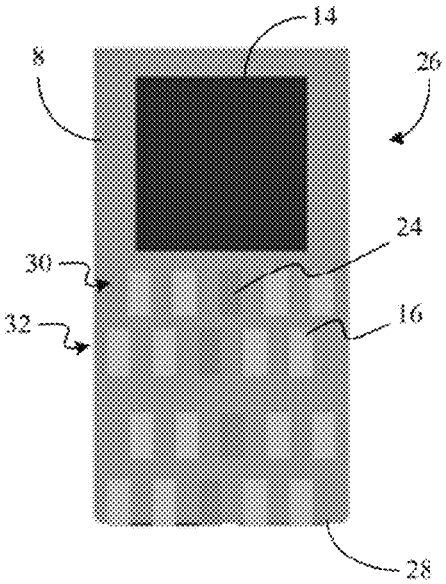
FIG. 3 shows example details of a host connector substrate according to an embodiment.

Existing external interfaces such as USB and eSATA (external Serial Advanced Technology Attachment, e.g., Serial ATA Rev. 3.0 Specification, May 27, 2009, SATA International Organization/SATA-IO) may rely on connector technology whose scalability may be limited to approximately 10 Gb/s. The emergence of new applications (e.g., external high definition/HD display, multi-terabyte solid state storage) could make it likely that consumer device bandwidth demand may exceed the available capacity of those interfaces. Additionally, explosive growth in the tablet and hand-held device industry may provide an opportunity to reduce the physical size of connectors. At the same time, existing connectors (e.g., USB3.0) might not be able to provide sufficient current capacity to support bus powered devices. The confluence of these factors may enhance the opportunity for a new connector technology that allows cost effective, performance scalable solutions for future generations of computing and consumer devices.

For example, FIGS. 1A and 1B provide a conceptual depiction of a mating interface 2. In particular, a male connector 4 is shown with respect to a female connector 6. The defining characteristic of what is a male connector 4 and a female connector may be the number of substrates provided therein. In the example shown, the male connector 4 is shown having a single substrate 8 and the illustrated female connector 6 has two substrates (shown in FIG. 5) that "sandwich" the single substrate 8. The housing shown is therefore not a determiner of which connector is male and female. In particular, the housing 10 of the female connector 6 would actually fit within housing 12 of the male substrate.

FIG. 2 shows a portion of a male connector that contains a substrate 8 and buffer 14, wherein contacts 16 are coupled to the substrate 8. The illustrated contacts 16 are interleaved on the substrate 8 in a four row deep configuration. Outer contacts 18 may constitute signal pairs 20 and 22, which are separated by reference contacts 24 in the center of each.

FIG. 3 shows a more detailed view of a signal side 26 of the substrate 8. In particular, the illustrated substrate 8 contains a buffer chip 14 that is integrated into the connector 4 (FIGS. 1A and 1B). Integration of the buffer chip 14 onto the connector allows the signaling channel to be reduced to the two high performance mated interfaces and a high performance cable. In the illustrated example, the length of the substrate 8 accounts for the plurality of rows of contacts 16 that are present on the substrate 8. One of the benefits to the additional rows of contacts 16 is that many more transmission pairs 20 and 22 than are used in a standard interface can be placed on a signal side 26 of the substrate 8. The substrate 8 may have a connection edge 28 that is the leading edge for engagement with a male interface (or female interface if the substrate is in a male connector), wherein the illustrated rows 30 and 32 may be parallel to the connection edge 28.

As shown with particularity in FIG. 3, the contacts of rows 30 and 32 are shown offset from each other. One of the advantages to offsetting the contacts is to avoid wear of the contacts as a male connector is repeatedly inserted and withdrawn from a female connector. An additional advantage of the offset is a proper mating of male connector contacts with female connector contacts. For example, a connected device may only operate if the contacts from the male connector line up with the contacts from a female connector. Thus, the greater the offset between rows, the lower the wear and the lower the chances of improper alignment between male and female contacts. The converse may also be true—the lower the offset between rows, the lower the wear and the lower the chances of improper alignment between male and female contacts.

Figure 4:
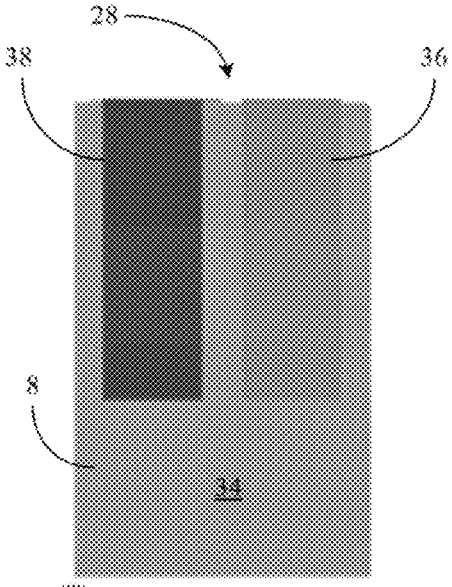
FIG. 4 shows an example of a signal side of the substrate of FIG. 3 according to an embodiment.

FIG. 4 shows a power side 34 of the substrate 8, wherein the power side 34 is a side opposite the signal side 26 (FIG.

3) and contains power contacts 36 and 38. The size of the power contacts 36 and 38 can be relatively large on the substrate 8 for the purpose of providing maximum current capacity. The illustrated power contacts 36 and 38 have a longitudinal axis that is substantially parallel to a longitudinal axis of the substrate 8, which is perpendicular to the connection edge 28 of the substrate 8. In the male connector, the signal contacts may be coupled to a signal side of the substrate 8 and the power contacts 36 and 38 (or a single power contact and a single ground contact) may be coupled to the power side 34, which is the second side of the same substrate 8. However, in a female connector 6 (shown in FIGS. 5 and 6), the signal contacts might be coupled to a first female substrate and the power contacts may be coupled to a second or independent substrate that is positioned within the connector in opposition to the first female substrate.

Figure 5:
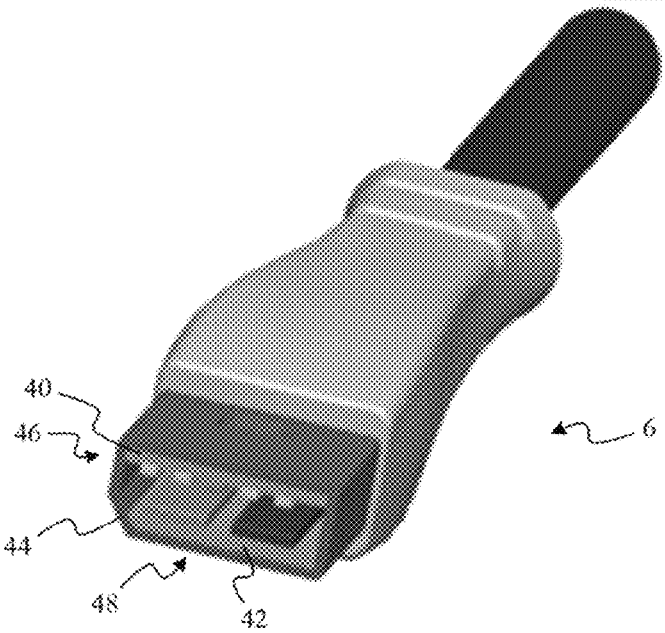
FIG. 5 shows an example of a power side of the substrate of FIG. 3 according to an embodiment.
Figure 6:
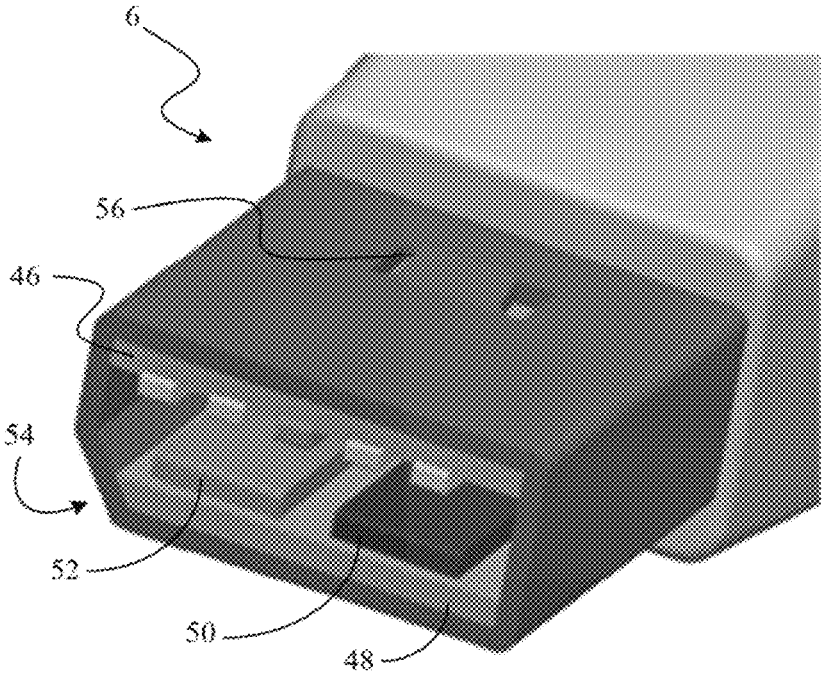
FIG. 6 shows an example of a female connector having two substrates according to an embodiment.

FIGS. 5 and 6 show a female connector 6, wherein a first substrate 40 and a second substrate 42 of the female connector 6 are arranged on a top side and a bottom side, respectively, of a connector housing 44. The illustrated housing 44 is configured as a metal shell to minimize emissions in order to avoid electromagnetic-interference ("EMI") compliance issues. The first substrate 40 may be the signal substrate, and can have a first surface (not shown) and a connection edge 46. Similarly, the second substrate 42 may be a power substrate, and can have a second surface and a connection edge 48. As with the male substrate, a plurality of rows of contacts are coupled to the first surface of the illustrated first substrate 40 and are configured such that they correspond to the contacts of a male connector, i.e., the contacts of the female connector are a mirror image of the contacts 16 (FIG. 2) of the male connector 4 (FIGS. 1A and 1B). Thus, the signal contacts of the female connector may be arranged parallel to each other and may be arranged parallel to the connection edge. A power contact 50 and a ground contact 52 are coupled to the second surface of the second substrate 42, in the example shown.

Thus, a housing of a male connector may include a single substrate that has a first side and second side, wherein the housing surrounds the substrate. To properly mate with a female connector, the substrate of the male connector can slide between and come in contact with both the first substrate and the second substrate of the female connector 6.

With further reference to FIG. 6, the housing 44 of the female connector 6 may possess a keyed cross-section to help a user properly align the first and second substrates with a male connector. A "keyed cross-section" may refer to the connector not being simply rectangular, but having some sort of recess, relief or other irregularity 54 that matches a corresponding irregularity of a mating connector and is built into the housing of the connector. To retain a male connector within a female connector, a latch or recess 56 can be placed in the housing of the female connector 4. The latch or recess 56 may correspond to a receptacle latch or recess of the male connector.

The housing of the illustrated female connector 6 has a width measuring no more than about 6 mm, a height measuring no more than about 3.3 mm, and a depth measuring no more than about 10 mm. The connectors of the connector can be pads, pins or protrusions. If the housing is male, the dimensions may be slightly less than the dimensions of the female housing. The illustrated buffer includes an integrated voltage regulator having one or more supply outputs coupled to one or more power contacts. The rows of contacts can be coupled to the first side of the substrate in a stacked configuration substantially parallel to the connection edge.

Alternating rows of contacts can also be staggered to form a plurality of lanes of contacts, wherein each lane of contacts is substantially perpendicular to the connection edge. Each row may include a plurality of signaling contacts and one or more ground contacts. As the disclosed IO connector is scalable across multiple generations, each lane of the disclosed IO connector might operate at about eight Gb/s. As such, with a total of eight lanes the total connector bandwidth is sixty-four Gb/s or more (e.g. 80 Gb/s). For the subsequent generations, each of the lanes might operate at 64 Gb/s, which would make the total achievable connector bandwidth 512 Gb/s or more (e.g. 640 Gb/s). As a result, over first, second and third generations, etc., the disclosed IO connector may be applicable to fifteen years' worth of bandwidth scalability.

The buffer 14 (FIG. 3) may have an integrated voltage regulator (VR) (not shown) capable of providing multiple, dynamically scalable, supply voltages. In particular, the VR can have a scalable first supply output (e.g., $V_{cc}$ IO) (not shown) coupled to a power contact 50 when a male connector is mated with female connector. The integration of IO circuits in the connector may provide data rate scalability, wherein, scalability can be made easier by tight integration of the buffer with the connector. For example, the illustrated buffer can determine how much power to allow to the connector so that the decision regarding power is removed from a computer's motherboard and placed in the buffer. Further, when a decision has to be made regarding whether to upgrade a connector's capabilities, the motherboard board does not necessarily have to be swapped out to affect the upgrade. Rather, the change can occur at the connector or the buffer. Thus, ease of scalability is made possible by the tight integration of the buffer with the connector.

Each lane may also be operable at less than maximum rates (e.g., 1 Gb/s as opposed to 8 Gb/s). Accordingly, the full bandwidth range for a connector could be 1 Gb/s with one operable lane or signal pair or as much as 512 Gb/s or more with eight 64 Gb/s lanes operable. Moreover, power may be scalable so that the power through the connector can be as low as approximately single digit milli-Watts to as high as approximately several Watts of power.

The contacts disclosed herein can be pads, pins, protrusions or other electrical contacts. If the contacts of the female connector are pads, the contacts of the male connector may be a protruding contact like a pin or other raised contact. Such a configuration can ensure proper coupling of the male and female contacts with each other. As stated above, the rows of contacts are offset from each other to avoid wear of the contacts. This may be a consideration in any configuration of contacts, but most importantly with the protrusions. The lower the amount of interference friction generated, the lower the amount of wear. The offset shown in FIGS. 2 and 3 is not meant as a limiting depiction. Rather, this offset is shown as an aid in understanding the meaning of offset rows. All four of the rows of contacts can be offset thereby reducing the interference friction by a factor of two. Contacts within a row can be placed on a 0.8 mm contact pitch for maximum density while at the same time providing high bandwidth by minimizing parasitic elements, i.e., parasitic capacitances due to proximity to other contacts, and matching the impedance to the channel. By making the contact short in height or thin, the area can be reduced. Also, by staggering the contracts, the overlapping area can be reduced.

Operability of each pad of the plurality of rows of pads may be determined based on the amount of data being transferred therethrough. Cost optimization can be achievable through selective population of the signal pairs. For example, if a device requires a bandwidth that can be satisfied by a differential pair, then only that pair might be connected from the device silicon to the device connector (mating pads may be included on the substrate). Alternately, the device could use more pairs than required, operating at a lower rate in order to provide a reduction in power consumption.

Bandwidth usage can be optimized by dynamically defining the transmission direction for each pair of contacts. In particular, a number of possible operable transceiver configurations are achievable. For example, the transmission direction can be unidirectional, bi-directional, simultaneously bi-directional, and so forth. In the unidirectional case, a transmitter can always be a dedicated transmitter and, similarly, a receiver can always be a dedicated receiver. In the bi-directional case, a data lane can be configured to be either a receiver or a transmitter at each side of the link. For simultaneous bi-directional configurations, both transmitter and receiver may share the same contacts and use them at the same time.

This disclosed IO interface may therefore allow tailoring the characteristics of the interface to a particular platform and can include a V-Squared trade-off in power vs. performance, as well as complete power down and fast re-start from power down.

Regarding the V-Squared trade-off, consider the CMOS circuit dynamic power consumption equation:

$$P=ACV^2F$$

where P is the power consumed, A is the activity factor, i.e., the fraction of the circuit that is switching, C is the switched capacitance, V is the supply voltage, and F is the clock frequency. If a capacitance of C is charged and discharged by a clock signal of frequency F and peak voltage V, then the charge moved per cycle is CV and the charge moved per second is CVF. Since the charge packet is delivered at voltage V, the energy dissipated per cycle, or the power, is $CV^2F$. The data power for a clocked flip-flop, which can toggle at most once per cycle, will be $\frac{1}{2}CV^2F$. When capacitances are clock gated or when flip-flops do not toggle every cycle, their power consumption will be lower. Hence, a constant called the activity factor ($0 \leq A \leq 1$) may be used to model the average switching activity in the circuit.

Advantages of the present interface may include the capability of spanning one to three generations (approximately fifteen years) of bandwidth scalability: 32 Gb/s to 512 Gb/s or more (e.g. 640 Gb/s) per pair data rate scaling and the use of multiple signal pairs. Scalability can be provided along two vectors: serial scalability by providing for higher data rates per pair, and parallel scalability by providing up to eight pairs per connector. Contributors to the operability of the disclosed interface include, but are not limited to, data rate scalability through the integration of IO circuits in the connector, flexibility to optimize bandwidth usage by dynamically defining a transmission direction for each pair flexibility to optimize cost for applications that do not require full bandwidth by populating only the required signals (i.e. "pay as you go"), robust power contacts to support up to 4 A consumption for bus powered devices, which is more than four times better than USB3.0, small size for use in clients such as desktops, laptops, netbooks, tablets, smartphone and a full range of consumer devices, legacy support for USB3.0 devices through the use of "dongles," similar to the way in which USB keyboards are connected to a PC via the PS/2 keyboard port, legacy support for lower bandwidth devices (e.g. keyboards, mice) via wireless connection, and so forth.

The present device may also improve the connector frequency performance by extending the usable bandwidth to well beyond 10 GHz (serial scalability), minimizing channel loss by integrating active repeater circuitry into the host connector (serial scalability) and using multiple lanes (parallel scalability). Existing solutions may be limited to 10 Gb/s or less, due in large part to connector bandwidth limitations.

The connector height may be equivalent to a USB "microB" connector, while occupying less than one half with width of a "Super Speed" microB connector, making it suitable for handheld devices and smartphones. If the housing of the connector is a female housing, it typically has a width measuring no more than about 5.3 mm, a height measuring no more than about 3.3 mm, and a depth measuring no more than about 5.3 mm. The connectors of the connector can be pads, pins or protrusions. If the housing is male, the dimensions may be slightly less than the dimensions of the female housing.

External IO interfaces such as USB interfaces, DP (Display Port, e.g., Embedded DisplayPort Standard (eDP) Version 1.3, January 2011, Video Electronics Standards Association) interfaces, HDMI ("High Definition Multi-media Interfaces", e.g., HDMI Specification, Ver. 1.3a, Nov. 10, 2006, HDMI Licensing, LLC), Thunderbolt interfaces, PCIE interfaces, or others with advanced power management features can be built while continuing to enable high performance when needed. Power consumption using the present connector can be tailored to the cost/power/performance characteristics of the interface to each platform, if desired.

The input/output (IO) connector may include a housing, a substrate, a plurality of rows of contacts, and a buffer. The substrate may be disposed within the housing and can have a first side, a second side and a connection edge. The buffer may be coupled to one of the first side or the second side of the substrate. In addition, the buffer may include an integrated voltage regulator having one or more supply outputs coupled to one or more power contacts. The rows of contacts can be coupled to the first side of the substrate in a stacked configuration substantially parallel to the connection edge. Alternating rows of contacts may also be staggered to form a plurality of lanes of contacts, wherein each lane of contacts is substantially perpendicular to the connection edge. In addition, each row may include one or more signaling contacts and one or more ground contacts.

One or more power contacts can be coupled to the second side of the substrate and the power contacts may have a longitudinal axis that is substantially parallel to a longitudinal axis of the substrate. One or more ground contacts can be coupled to the second side of the substrate, wherein the ground contacts have a longitudinal axis that is substantially parallel to the longitudinal axis of the substrate.

A male interface may have a single substrate with two interfacing surfaces. However, in a female connector, two substrates can be configured in opposition to each other. A first substrate may have a first surface and a connection edge, and a second substrate may have a second surface and a connection edge, wherein, the first and second surfaces oppose each other. Multiple rows of contacts may be coupled to the first surface so that they are arranged parallel to each other and to the connection edge. A power contact may also be coupled to the second surface. The housing can possess a keyed cross-section to help a user properly align the first and second substrates with a male connector. As already noted, the contacts can be pads, pins, protrusions or other electrical contacts, wherein operability of each pad of the plurality of rows of pads is determined based on the amount of data and/or current being transferred there through.

The illustrated connector therefore overcomes an inability of conventional connectors to take only that power required for operation. As such, when a device is connected to a laptop running on battery power, for example, the connection may not apply a greater load on the battery than is necessary for proper operation of the device.

Embodiments may therefore include an IO connector having a housing and a substrate disposed within the housing, wherein the substrate includes a first side, a second side and a connection edge. The IO connector may also have an integrated buffer coupled to at least one of the first side and the second side of the substrate, and a plurality of rows of contacts coupled to the first side of the substrate. Each row of the contacts may be stacked substantially parallel to the connection edge.

Embodiments may also include an IO interface having a substrate with a first side, a second side and a connection edge. The IO interface can also have an integrated buffer coupled to at least one of the first side and the second side of the substrate, and a plurality of rows of contacts coupled to the first side of the substrate. Each row of contacts may be stacked substantially parallel to the connection edge.

In addition, embodiments may include a female connector having a first substrate with a first surface and a connection, and a second substrate with a second surface, wherein the second surface opposes the first surface of the first substrate. The female connector can also have a housing surrounding the first substrate and the second substrate, and a plurality of rows of contacts coupled to the first surface and arranged parallel to each other and to the connection edge.

Moreover, embodiments can include a male connector having a substrate with a first side and a second side, and a housing surrounding the substrate, wherein the housing is keyed on an edge thereof. The male connector may also have at least one power contact connected to the first side of the substrate, and a plurality of rows of contacts arranged on the second side of the substrate. Each row of the plurality of rows can be parallel to each other and to an engagement edge of the substrate.

Example sizes/models/values/ranges may have been given, although embodiments of the present invention are not limited to the same. As manufacturing techniques mature over time, it is expected that devices of smaller sizes could be manufactured. In addition, well known power/ground connections to IC chips and other components may or may not be shown within the figures, for simplicity of illustration and discussion, and so as not to obscure certain aspects of the embodiments of the invention. Further, arrangements may be shown in block diagram form in order to avoid obscuring embodiments of the invention, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments of the invention, it should be apparent to one skilled in the art that embodiments of the invention can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. might be used herein only to facilitate discussion, and carry no particular temporal or chronological significance unless otherwise indicated.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

We claim:

1. An input/output (IO) connector comprising:

a first housing to receive therein a second housing;

a substrate within the first housing, wherein the substrate comprises a first side, a second side opposite the first side, and a connection edge between the first side and the second side, and the substrate is to slide within the second housing;

a first row of electrical contacts on the first side of the substrate comprising a plurality of differential pairs of signal electrical contacts and a plurality of ground electrical contacts to couple to a first row of electrical contacts on a first side of an interior of the second housing; and a second row of electrical contacts on the second side of the substrate comprising a plurality of power electrical contacts and a plurality of ground electrical contacts to couple to a second row of electrical contacts on a second side of the interior of the second housing, wherein the first side of the interior of the second housing is opposite the second side of the interior of the second housing, wherein the IO connector comprises at least five Universal Serial Bus (USB) differential pairs of signal electrical contacts.

2. The IO connector of claim 1, wherein each electrical contact in the first row on the first side of the substrate is equally spaced apart and each electrical contact in the second row on the second side of the substrate is equally spaced apart.

3. The IO connector of claim 1, wherein the second row of electrical contacts on the second side of the substrate comprises at least three power electrical contacts.

4. The IO connector of claim 1, wherein the second row of electrical contacts on the second side of the substrate comprises a plurality of differential pairs of signal electrical contacts.

5. The IO connector of claim 1, wherein the IO connector is a host IO connector.

6. The IO connector of claim 5, wherein the IO connector is a Universal Serial Bus (USB) interface.

7. The IO connector of claim 1, comprising at least six and up to eight Universal Serial Bus (USB) differential pairs of signal electrical contacts.

8. The IO connector of claim 1, wherein the second housing comprises a cable.

9. The IO connector of claim 1, wherein the electrical contacts comprise pins.

10. The IO connector of claim 1, wherein the electrical contacts comprise pads.

11. A circuit comprising:

an input/output (IO) connector;

a first transmitter to couple to a second receiver through the IO connector; and a first receiver to couple to a second transmitter through the IO connector, wherein the IO connector comprises:

a first housing to receive therein a second housing;

a substrate within the first housing, wherein the substrate comprises a first side, a second side opposite the first side, and a connection edge between the first side and the second side, and the substrate is to slide within the second housing;

a first row of electrical contacts on the first side of the substrate comprising a plurality of differential pairs of signal electrical contacts and a plurality of ground electrical contacts to couple to a first row of electrical contacts on a first side of an interior of the second housing; and a second row of electrical contacts on the second side of the substrate comprising a plurality of power electrical contacts and a plurality of ground electrical contacts to couple to a second row of electrical contacts on a second side of the interior of the second housing, wherein the first side of the interior of the second housing is opposite the second side of the interior of the second housing, wherein the IO connector comprises at least five Universal Serial Bus (USB) differential pairs of signal electrical contacts.

12. The circuit of claim 11, wherein each electrical contact in the first row on the first side of the substrate is equally spaced apart and each electrical contact in the second row on the second side of the substrate is equally spaced apart.

13. The circuit of claim 11, wherein the second row of electrical contacts on the second side of the substrate comprises at least three power electrical contacts.

14. The circuit of claim 11, wherein the second row of electrical contacts on the second side of the substrate comprises a plurality of differential pairs of signal electrical contacts.

15. The circuit of claim 11, wherein the IO connector is a host IO connector.

16. The circuit of claim 15, wherein the IO connector is a Universal Serial Bus (USB) interface.

17. The circuit of claim 11, wherein the IO connector comprises at least six and up to eight Universal Serial Bus (USB) differential pairs of signal electrical contacts.

18. The circuit of claim 11, wherein the second housing comprises a cable.

19. The circuit of claim 11, wherein the electrical contacts comprise pins.

20. The circuit of claim 11, wherein the electrical contacts comprise pads.

* * * * *